US006234428B1

(12) United States Patent
Bächtiger et al.

(10) Patent No.: US 6,234,428 B1
(45) Date of Patent: May 22, 2001

(54) SELECTIVE DATA TRANSMISSION PROCESS AND DEVICE FOR COMMUNICATION SYSTEMS USED IN TRAFFIC ENGINEERING

(75) Inventors: Rolf Bächtiger, Oberwil-Lieli; Max Loder, Bonstetten, both of (CH)

(73) Assignee: Siemens Schweiz AG, Zurich (CH)

( * ) Notice: Subject to any disclaimer, the term of this patent is extended or adjusted under 35 U.S.C. 154(b) by 0 days.

(21) Appl. No.: 09/142,054

(22) PCT Filed: Apr. 17, 1997

(86) PCT No.: PCT/CH97/00153

§ 371 Date: Sep. 17, 1998

§ 102(e) Date: Sep. 17, 1998

(87) PCT Pub. No.: WO97/39934

PCT Pub. Date: Oct. 30, 1997

(30) Foreign Application Priority Data

Sep. 19, 1996 (CH) ..... 996/96

(51) Int. Cl.[7] ..... B61C 27/00
(52) U.S. Cl. ..... 246/7; 246/5
(58) Field of Search ..... 246/5, 6, 7, 187

(56) References Cited

U.S. PATENT DOCUMENTS 3,979,091 * 9/1976 Gagnon et al. ..... 246/8
4,711,418 * 12/1987 Aver, Jr. et al. ..... 246/5
4,735,383 * 4/1988 Corrie ..... 246/3

FOREIGN PATENT DOCUMENTS 2164825 3/1986 (GB) .
2194091 2/1988 (GB) .
94/11754 5/1994 (WO) .

OTHER PUBLICATIONS

G. Cooper, *Modern Communications and Spread Spectrum,* Chapts. 8 and 9, pp. 268–318 (1986).

E. Herter et al., Nachrichtentechnik, Chapt. 8.8.3.2. (1994).

* cited by examiner

*Primary Examiner*—S. Joseph Morano
*Assistant Examiner*—Robert J. McCarry, Jr.
(74) *Attorney, Agent, or Firm*—Herbert L. Lerner; Laurence A. Greenberg; Werner H. Stemer

(57) ABSTRACT

A process is disclosed for communication systems used in traffic engineering and having an earthbound transponder for each corresponding track section. The transponders transmit first data through a first path of transmission to polling machines arranged on vehicles. Based on these first data, the concerned polling machine ascertains whether second data transmitted through a second path of transmission to the polling machine are really destined for the vehicles. The signal in the second path of transmission destined for the vehicles of a section of the track is individually modulated or transmitted by a time- or frequency-multiplexing process. Depending on the selected modulation or multiplexing, coefficients are built at the emitter side which are then transmitted through the first path of transmission, extracted at the receiver side and used to demodulate or demultiplex the signal transmitted through the second path of transmission. The physical separation of the transmitted signals makes it possible to ascertain whether the signals received through the second path of transmission are destined for this section of the track or the vehicles that circulate thereon.

19 Claims, 7 Drawing Sheets

SELECTIVE DATA TRANSMISSION PROCESS AND DEVICE FOR COMMUNICATION SYSTEMS USED IN TRAFFIC ENGINEERING

BACKGROUND OF THE INVENTION

1. Field of the Invention

The present invention relates to a process and a communication system, and more particularly, to a selective data transmission process and device for communication systems used in traffic engineering.

2. Discussion of Background Information

In order to assure the safe management of railroad operation, information regarding the status of the line section to be traveled must be communicated to the vehicles traveling on the rail network. Today mostly light signal systems that are controlled by a signal tower are used for this purpose, which systems indicate the closure or clearing of a line section and any other information to the engine driver. With increasing traffic density and higher speeds, the required reliability and safety of the information transmission can no longer be assured by means of this optical transmission path. Particularly under unfavorable weather conditions, the recognition of the signals is no longer assured with absolute certainty nor is the reliable association to the proper track when there is multi-track routing of rails.

For a long time, therefore, transponders have been affixed in the track, by means of which the optically signalized data are transmitted in parallel on an electrical path. These ground-based transponders can be queried over a very small air gap of a few centimeters by means of a radio station or interrogator fastened to a vehicle. It is therefore assured with a great deal of certainty that the data belonging to a track being traveled is always transmitted only to a vehicle that is traveling on this track. Since the incorrect reading of a transponder in the neighboring track is not possible for physical reasons (insufficient range of the query system), the track selectivity is thus assured.

However, the query range of the transponder system, which has been kept deliberately low to achieve the track selectivity, on the other hand has the disadvantage that the communication between the ground-based transponder and the mobile interrogator can only occur when the distance is very small. If the vehicle stops at a point at which there is a large distance between the transponder and the interrogator, e.g. in a train station, then a data inquiry is no longer possible. In order to assure the data transmission from the line section to the train over longer periods, transmission systems are therefore used, with linear antennae that extend in the direction of the track. An antenna of this kind is described, for example, in K. Bretting, Abstrahlende Hochfrequenzleitung zur Bahnsteig-Überwachung, [Radiating High-Frequency Line for Platform Monitoring], Funkschau, Vol. 47, No. 13, 1975 Munich DE, pp. 66–68. It turns out that even with linear antenna, the overcoupling into the neighboring track cannot be prevented with absolute certainty.

In order to eliminate this uncertainty, according to a known process, a transponder is provided at both ends of the line antennae in each track, and these transponders perform the function of markers. Before a vehicle travels a line section equipped with a line antenna, it passes one of these transponders, by means of which a track identification is transmitted to the interrogator attached to the bottom of the vehicle (allocation of a track address or vehicle address). Due to the query range that has been kept deliberately low, the data of the transponder in the neighboring track cannot be received (cross-talk security). As soon as the vehicle subsequently comes into the region of the line antenna, it receives the message sent by the signal tower, which also contains a section provided with the same track identification. In a computer disposed on board the vehicle, the two messages received from the transponder and the linear antenna are compared with regard to track identification. When the track identification transmitted by the line antenna and (supposedly) by the transponder are not the same, e.g. when the travel plan is arrived at by means of undesirable physical cross-talk from the neighboring track to the vehicle, the whole message received, with the travel plan contained in it, is recognized as invalid and is discarded.

With a high degree of certainty, this known process prevents a particular travel plan, which has been received by means of cross-talk in the neighboring track, from being evaluated. With the use of the linear antenna, the phenomenon of cross-talk, however, is therefore not eliminated. The cross-talking signal can interfere with the desired signal in the track section and can make receiving impossible or can even cause bit errors. The above-described track identification, as a safety encoding, to a large extent prevents an incorrect evaluation or misinterpretation. The receipt of the useful data, however, cannot as a result be assured.

SUMMARY OF THE INVENTION

Therefore, the object of the current invention is to disclose a process and a traffic engineering communication system by means of which an error-free association of transmitted messages to a line section (track selectivity) as well as a transmission that is freed of interfering influences can be assured.

This object is attained by means of the measures disclosed in the characterizing part of claim 1 or 9. Advantageous embodiments of the invention are disclosed in other claims.

The process according to the invention permits the receiving-end physical separation of the messages designated for the individual track sections. In another manner than in the known process, in which the applicable message is detected without suppression of interference signals in using the track identification, with the physical separation, a drop in the level of the interference signals occurs. By means of the process according to the invention, therefore, not only does the separation of the individual signals succeed, but it also permits the receipt of messages during the occurrence of intense interference signals. In contrast to the known processes with addressing, in this instance, a virtually unlimited number of subscribers (or vehicles) can cooperate.

The process is particularly provided for communication systems that have line antennae. By means of another embodiment of the invention, preferably at traffic node points, the laying of line antennae in the related track sections can be eliminated. The separation according to the invention of the different messages permits their radiation from a single antenna, which covers the provided track region. As a result, a sharply reduced expense of manufacture, installation and cost outlay results for the entire communication system.

A preferable embodiment of the invention furthermore permits the communication of a control point or base station with two vehicles that are disposed on the same track section and communicate with the base station via radio or a common line antenna.

BRIEF DESCRIPTION OF THE DRAWINGS

The invention will be explained in detail by way of example below in conjunction with drawings.

DETAILED DESCRIPTION OF THE PRESENT INVENTION

Figure 1:
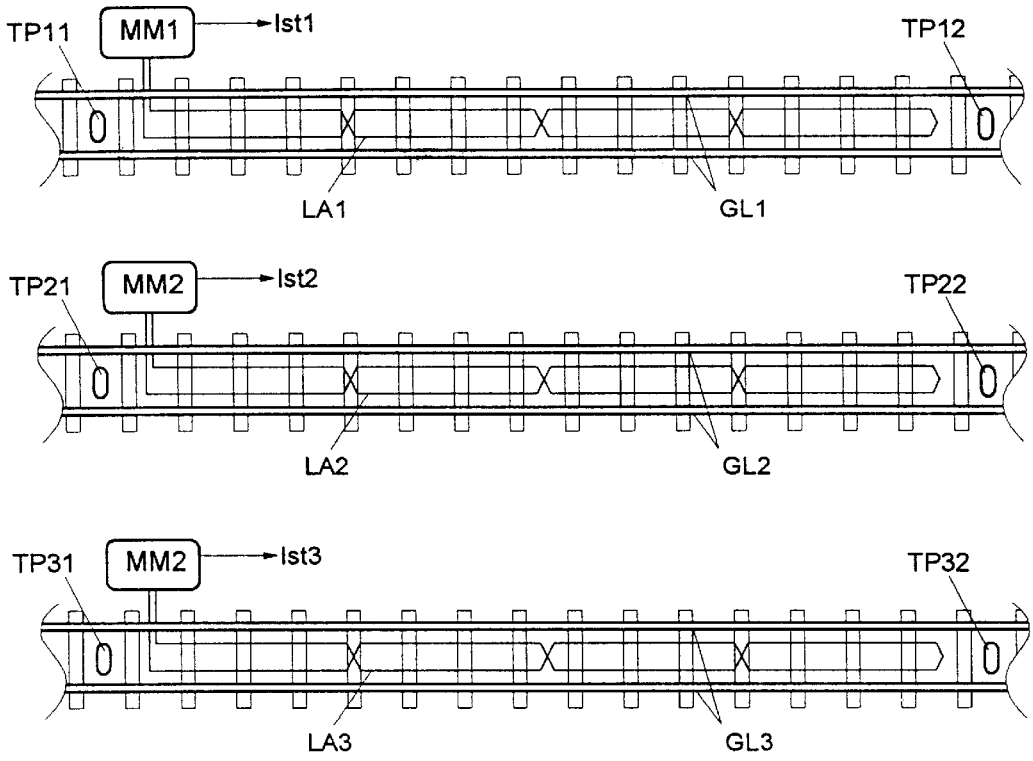
FIG. 1 shows parallel-guided track sections that are each provided with a line

FIG. 1 shows three parallel routed track sections GL1, GL2, GL3, which are each provided with a line antenna LA1, LA2, LA3, and these antennae are connected by way of a marking module MM1, MM2, or MM3 and connecting lines Ist1, Ist2, Ist3 to a signal tower or control unit, from which data can be dispatched to the vehicle traveling on the tracks GL. At both ends or normally in immediate proximity to the line antennae LA1, LA2, LA3, further transponders TP11, TP12; TP21, TP22 or TP31, TP32 (also called END OF LINE MARKER; EOLM) are provided, by means of which the vehicles have previously been sent track identifications. This and the succeeding exemplary embodiments refer to the use of the invention in railroad traffic. By means of purely expert measures, though, the invention can be used generally in traffic engineering.

In lieu of (see FIG. 3) or in addition to (see FIG. 4) a track identification, the vehicles receive a coefficient set in an encoded, definite form when passing a transponder TP11 or TP12; TP21 or TP22, and TP31 or TP32, respectively, which coefficient set enables the interrogator of the vehicle to physically separate the messages sent by the signal tower by way of the line antennae LA1, LA2, or LA3, i.e. to allow only the (physically) correctly addressed messages to pass.

Figure 3:
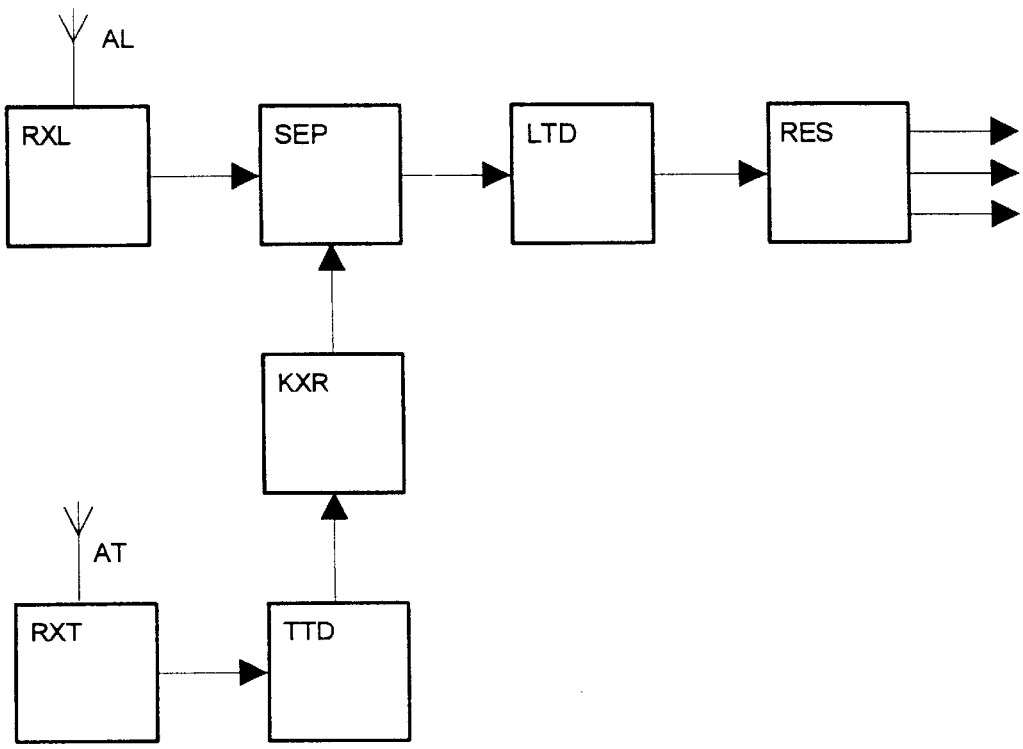
FIG. 3 shows a receiving device provided in a vehicle.

FIG. 3 shows the receiving part of an interrogator, which has two receiving modules RXL or RXT connected to an antenna AL or AT. The first receiver module RXL, which is provided for receiving the signals emitted by a line antenna LA, is connected by way of a separation stage SEP and preferably a first message decoder LTD, in which the message is re-composed and tested, to an evaluation unit RES (e.g. the vehicle computer) from which the data received (driver information, control commands, etc.) is dispatched to the pickups present in the vehicle. The separation stage SEP, which is normally embodied as a demultiplexer or correlator, is used for the physical separation of the signals belonging to the track GL1; GL2 or GL3 being traveled. The second receiving module RXT, which is provided for receiving the signals emitted by a transponder TP11 or TP12; TP21 or TP22, and TP31 or TP32, respectively, is preferably connected by way of a second message detector TTD and a coefficient extractor KXR to the separation stage SEP, which is supplied with the data (coefficients, etc.) necessary for signal extraction by way of this route.

Figure 5:
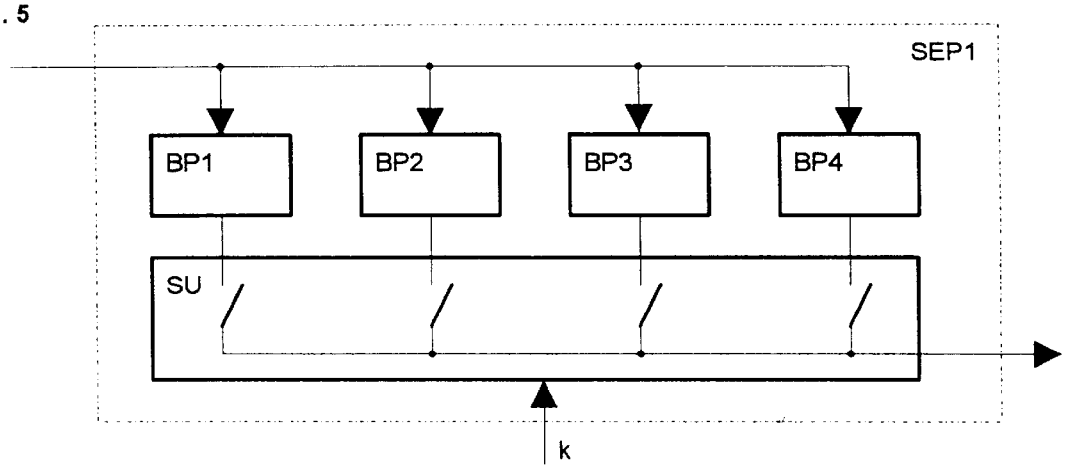
FIG. 5 shows a device for extraction of signals transmitted in accordance with the frequency division multiplexing process.

If the messages from the signal tower are transmitted by way of a line antenna LA in accordance with the frequency division multiplexing process, then the signal extraction in the separation stage SEP must take place through frequency selective means. In this instance, as shown for example in FIG. 5, a separation stage SEP1 with e.g. four band-pass filters BP1, . . . , BP4 can be used, which filters can be alternatively hooked up by means of a switch unit SU. By means of the coefficient set received from a transponder TP when traveling the track GL, the applicable frequency channel can be selected by means of hooking up the corresponding band-pass filter BP. If, for example, the travel plan for track 1 is transmitted in the frequency channel 1, then the separation stage SEP must meet a switching criterion from the received coefficient set so that the band-pass filter 1 is switched through to the output. The number of band-pass filters BP thereby corresponds to the number of the tracks GL to be addressed.

Figure 6:
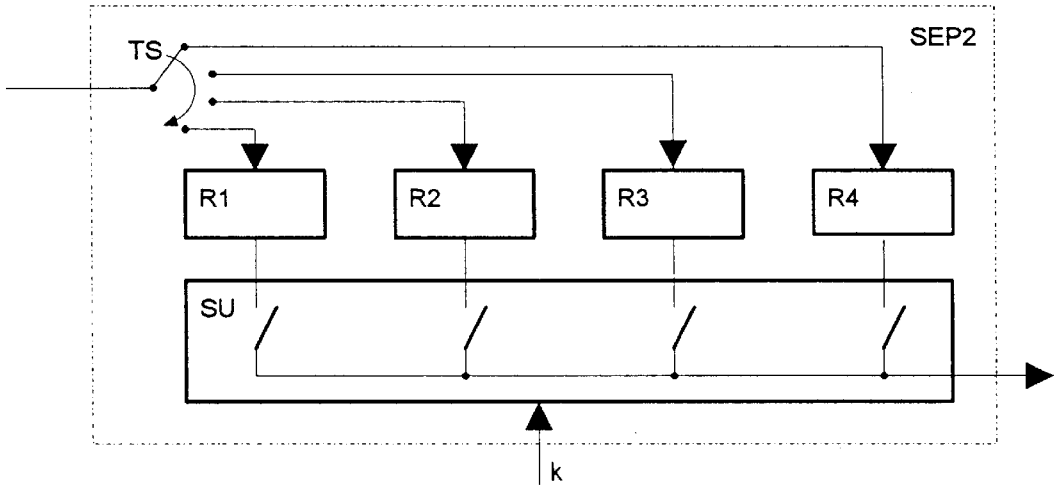
FIG. 6 shows a device for extraction of signals transmitted in accordance with the time division multiplexing process.

If the messages from the signal tower are transmitted via the line antenna LA in accordance with time division multiplexing process, then the receiving-end signal extraction system e.g. in the separation stage SEP2 shown in FIG. 6 is executed by means of selective storage of the messages, which have arrived in a chronological order, in registers R1, . . . , R4, which are addressed and read in accordance with the coefficient set received. For the chronologically correct distribution of messages, a switch TS is provided in the separation stage SEP2 and connects the output of the first receiving module RXL to the associated inputs of the registers R1, . . . , R4 in the different time periods. Processes for switching through data in time division multiplexing are known to the expert, e.g. from P. Bocker, Datenübertragung [Data Transmission], Springer Verlag, Berlin 1978, Vol. 1, p. 237. In accordance with the coefficient set received from the transponder TP, the switch unit SU forwards only the data of the register R that applies for the track respectively traveled.

Figure 7:
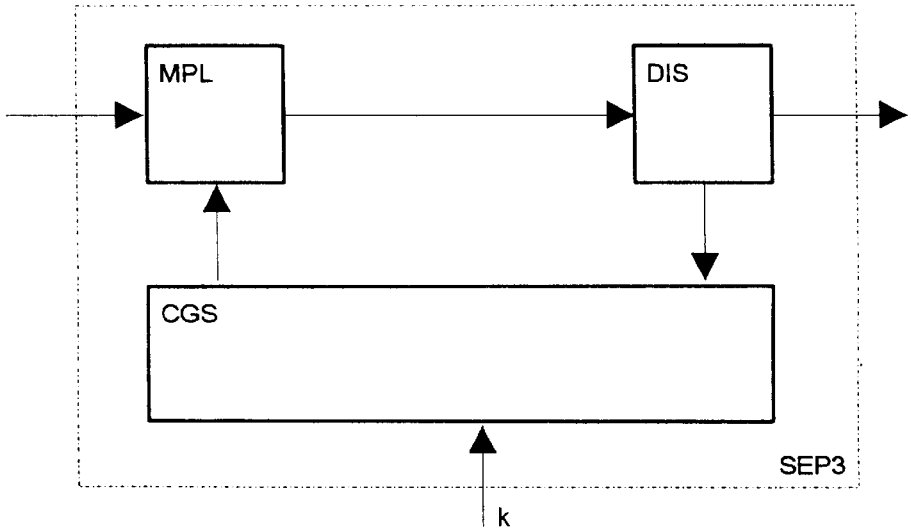
FIG. 7 shows a device for extraction of signals transmitted in accordance with the CDMA process.

The transmission from the signal tower to the vehicles occurs in a particularly advantageous manner, in accordance with the code division multiple access process (CDMA) described in R. Steele, Mobile Radio Communication, Pentech Press Ltd, London 1992 (reprint 1994), pp. 45 to 51. FIG. 7 shows the block circuit diagram of a CDMA correlator provided in the separation stage SEP3 for processing the CDMA-encoded signal, which correlator includes a multiplier MPL, a demodulator/integrator DIS, and a code generator CGS. According to the CDMA process, on the sending end, each data bit to be transmitted is divided according to an individually established p-n code, into a sequence of pulses or chips. The inverse application of the p-n code occurs for a logical 0. The splitting of the data bits 0 and 1 into pulse sequences (inverse to each other) produces a broadening of the performance spectrum (see loc. cit., p. 46, FIG. 1.30). By means of the receiving-end decoding of a received CDMA signal with the correct p-n code, the data bit is restored to the original form, by means of which a narrower performance spectrum arises with a sharply increased peak value. However, if the CDMA signal is decoded using an incorrect p-n code, then only the form of the pulse sequence changes; a narrowing of the performance spectrum does not occur. The probability of cross-talk from the neighboring tracks GL onto a vehicle traveling at a distance is therefore reduced. The CDMA-encoded reception signals in the separation stage SEP3 first pass through the multiplier MPL and in it, are multiplied with the p-n code and are consequently "unspread". That is, each data bit 0 and 1 which, on the transmission end, is divided up into a number of chips, is multiplied by the p-n code, by means of which each chip of a divided-up data bit 0 and 1 is provided once more with the correct operational sign (in binary phase-encoded signals (BPCS), the binary phase modulation is eliminated). In the subsequent demodulator/integrator DIS, the unspread receiving signal is converted and integrated into the base band. If the two code sequences multiplied with each other precisely coincide chronologically and with regard to the code, then a signal that is excessive with regard to the amplitude appears at the output of the integrator and this signal triggers the threshold of a pulse generator in the subsequent signal processing. If the threshold is correctly chosen, then correctly decoded data bits can be easily detected. Incorrectly decoded data bits are not capable of exceeding the threshold provided. The synchronous supplying of the p-n code determined by means of the coefficients is carried out by the code generator CGS. By means of the transmitted coefficients, therefore, a p-n code that is stored in the code generator CGS is retrieved and prepared. The linkage of the spread data bits 0 and 1 to the selected p-n code occurs in such a way that the starting times of both sequences coincide. Therefore the signal cycle must be recovered from the transmitted signal with means which are known, for example, from G. Cooper, Modem Communications and Spread Spectrum, McGraw Hill Book Co., Singapore 1986, pp. 268–318. In it, the above-described process is called the direct sequence spread spectrum process. A circuit arrangement for regenerating the transmitted signal is shown on page 275, loc. cit., in FIGS. 8–9. The regenerated signal is used in this connection as a reference for a discriminator, which is provided in the code generator CGS, and the output signal of this discriminator controls a clock oscillator. A correlation of the received signals can take place both digitally with a signal processor and in analog fashion, as described in WO 94/11754, e.g. by means of surface acoustic wave components or SAW components.

Figure 4:
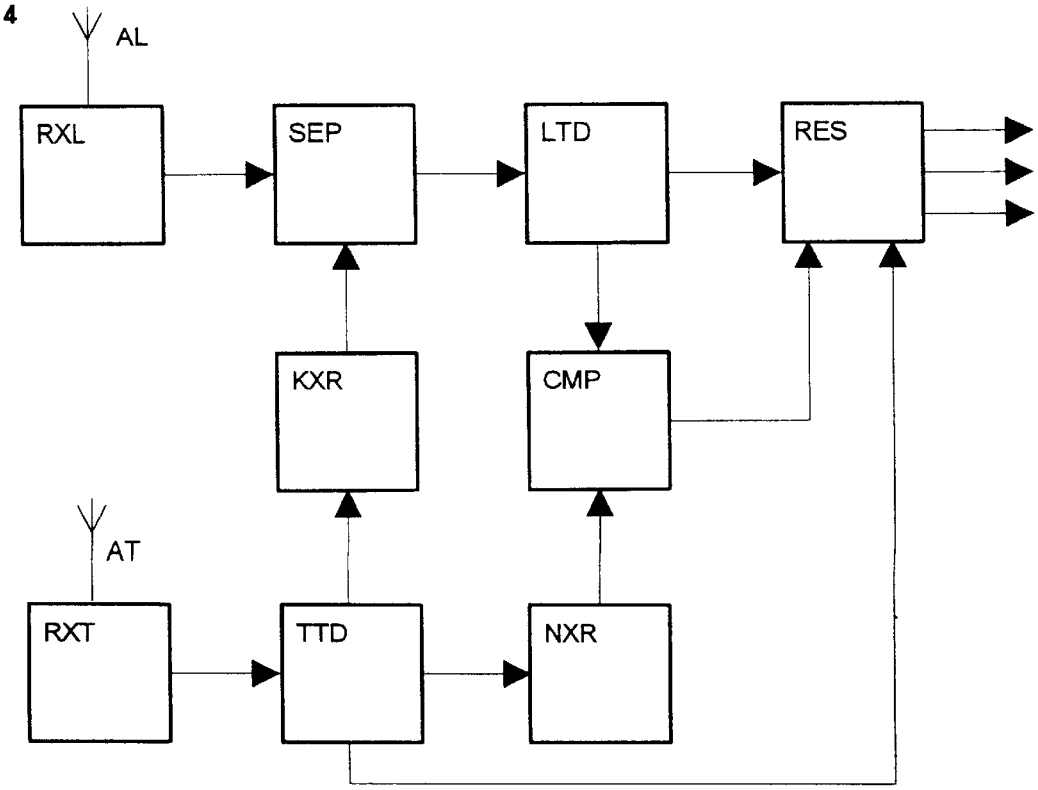
FIG. 4 shows the receiving device shown in FIG. 3, modified by means of modules that are provided for checking the track identification.

In addition to the circuit shown in FIG. 3, the receiving circuit shown in FIG. 4 has an identification data extractor NXR, which extracts the track identification transmitted by the transponder TP from the messages supplied by the second message detector TTD and supplies it to a comparator CMP, which is supplied by the first message detector LTD with the track identification, which has been transmitted by the signal tower by way of the line antenna LA. The comparator CMP compares the track identifications supplied by way of the transponder TP and the line antenna LA and informs the evaluation unit RES as to whether the received messages should be rejected or processed further. Data transmitted by the transponder TP can furthermore be supplied directly to the evaluation unit RES by means of the second message detector TTD.

When traveling past over a transponder TP functioning as a track marker, at the beginning of a track section GL being taken into consideration, a coefficient set and if need be, track identification data are received by means of the receiving device shown in FIG. 4. If these data have been security encoded on the transmission end, they must be tested and decoded on the receiving end in the message decoder TTD provided for this. Naturally, other data, e.g. the precise positioning data of the transponder and data with regard to routing, can be transmitted by way of the track-side transponder TP. The data that mark the track section and data that are required in the coefficient extractor KXR for the physical signal separation must therefore be extracted in the track identification data extractor NXR. The track identification data are supplied to the comparator CMP. At the same time or shortly thereafter, the messages from the signal tower are also either received via radio channel or by way of the air gap between the line antenna LA in the track GL and the antenna AL on the vehicle. In addition to the travel plan, these messages also contain the appropriate track section as a target address.

With the device explained at the beginning according to FIG. 1, the specific message is emitted in each track section. To that end, a line antenna LA1, LA2, or LA3 is provided in each track GL1, GL2, and GL3 and is connected with a certain cost. Based on the possibility of physically separating the signals transmitted to the tracks GL1, GL2, and GL3, which signals can interfere with each other, with the process according to the invention, the line antennae LA1, LA2, and LA3 are preferably replaced by means of at least one preferably centrally provided antenna A (see FIG. 2) by way of which signals are transmitted to all vehicles, e.g. according to the code, time, or frequency division multiplexing process (CDMA, TDMA, or FDMA). The interrogators provided in the vehicles are in a position, according to the invention, to extract the appropriate signal from the signal mixture received.

Figure 8:
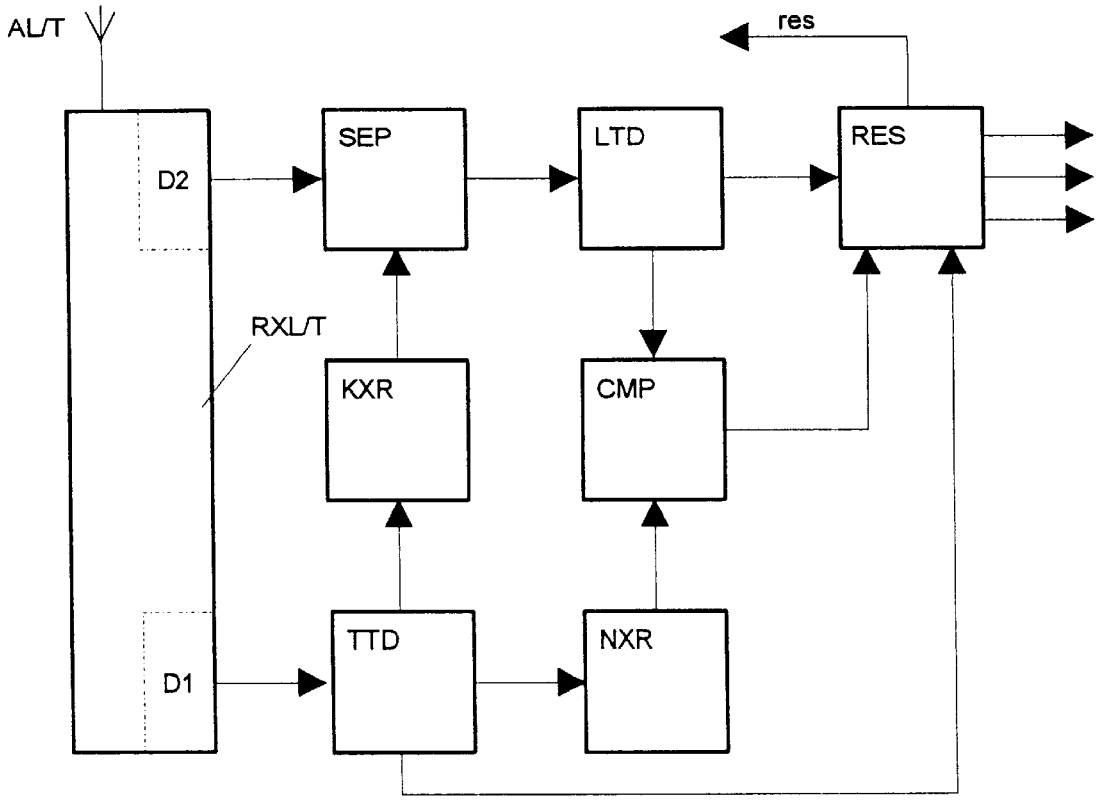
FIG. 8 shows the device according to FIG. 4, realized with a common receiving channel for the signals from the line conductors and the transponders.

FIG. 8 shows the device according to FIG. 4, realized with a common receiving channel, which is comprised of an antenna AL/T and a receiving module RXL/T, which are designed to be wide-band, so that the signals emitted by the line conductors LA and the transponders TP can be processed and dispatched separately to the separation stage SEP and the message detector TTD. The transmission frequency bands of the signals from the line antenna LA (or the common antennae A) and from the transponders TP can be disposed close to one another or can even be identical so that only one signal path has to be provided in the receiving module RXL/T for the two signals that are preferably received only by the one antennal AL/T. For the signals transmitted in both channels, preferably an orthogonal modulation is provided so that the signals (or the signal mixture) that have, for example, the same average frequency can be supplied, after preparation in the receiving module RXL/T, to a first and a second demodulator D1, D2 and can be separated again there due to the different modulation. For example, the amplitude modulation and the frequency modulation are provided for the modulation of both signals. The band-width demand of the system can be reduced by means of these measures. Furthermore, the limited space conditions at the positions of the vehicle that are provided for mounting the interrogator can be taken into consideration through the use of only one antenna A/LT.

Preferably, the evaluation unit RES shown in FIG. 8 also determines (e.g. in addition to the direction of travel) whether the data received from the transponders (e.g. TP11 or TP12) are still valid. The signals received from the transponders TP11 or TP12 should assure that only the signals transmitted by the line antenna LA1 will be processed further. In the event that a vehicle has now passed the first transponder TP11 and the line antenna LA1, this is determined by the evaluation unit RES upon reaching the second transponder TP12, whereupon the coefficients k that are no longer valid are preferably deleted by a reset, signal res provided that the vehicle has not changed direction and again passed the line antenna LA1.

Figure 9:
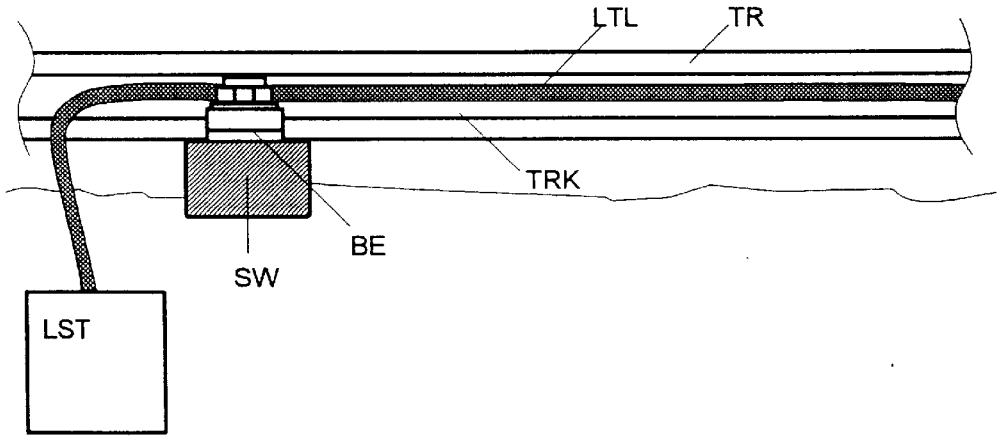
FIG. 9 shows a leakage cable serving as a line antenna.

FIG. 9 shows a leakage cable LTL (leaky cable), which serves as a line antenna and is connected to a signal tower LST, and this cable is mounted in the groove TRK of a railroad track and respectively affixed to the rail tie SW with a fastening device BE. Leakage cables are described, for example, in Bretting, Abstrahlende Hochfrequenzleitung . . . [Radiating High-Frequency . . . ], FUNKSCHAU, Vol. 47, No. 13, Munich 1975, pp. 66–68.

Figure 2:
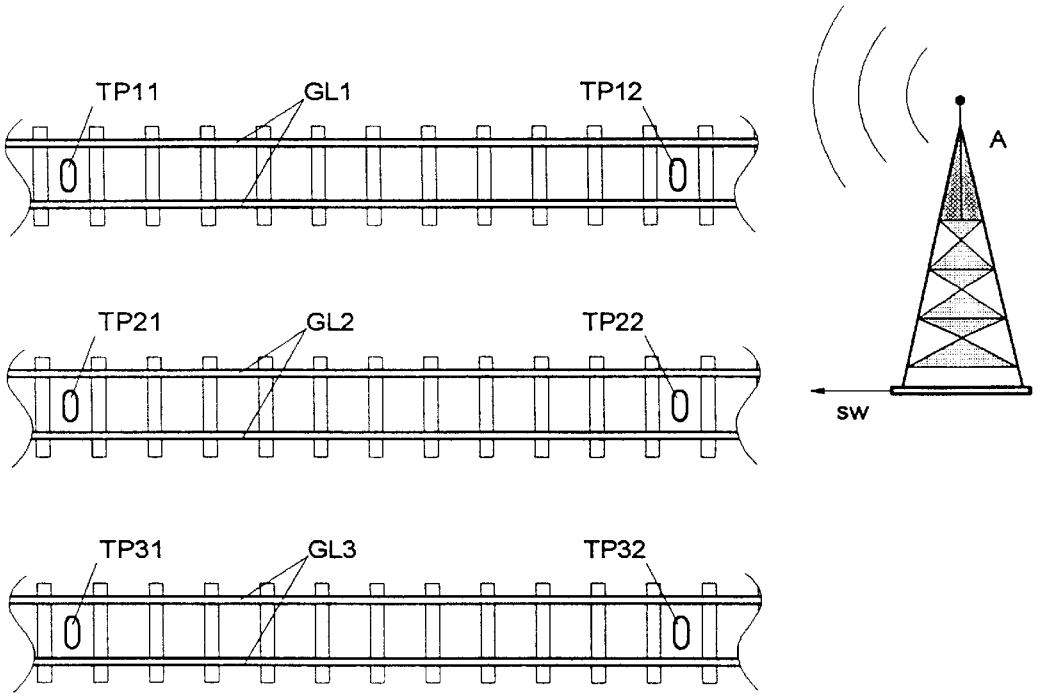
FIG. 2 shows parallel-guided track sections that are in the sending region of a radio
Figure 10:
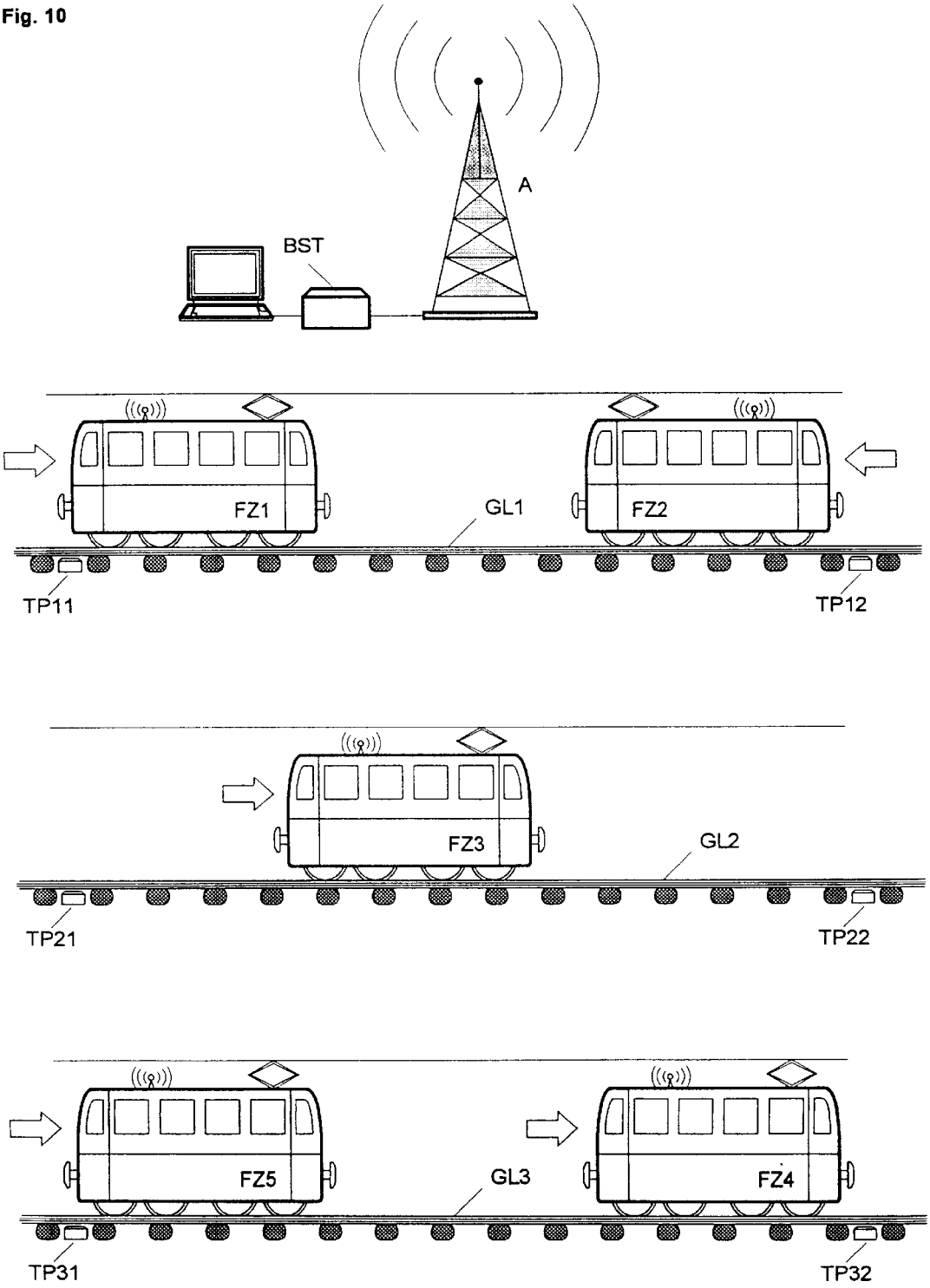
FIG. 10 shows the track sections shown in FIG. 2, with vehicles that communicate with a base station via radio.

FIG. 10 shows the track sections GL1, GL2, and GL3 shown in FIG. 2, with vehicles FZ1, . . . , FZ5 traveling on them, which communicate with a base station BST by radio. The preferred embodiment of the invention described below can also be used when the vehicles FZ1, . . . , FZ5, as shown in FIG. 9, communicate with the base station BST via a line antenna LTL. As regards the vehicle FZ3, which is traveling in the track section GL2, the process according to the invention can be carried out unchanged. When traveling over the transponder TP21, the vehicle FZ3 receives a code word, a frequency channel, a time slot, or coefficients dispatched via the first transmission path, and in conjunction with these, the signals, which are transmitted via the second transmission path (by radio or inductively via the line antenna) and are designated for the vehicle FZ3, can be correctly processed.

Particular situations exist with regard to the track sections GL1 and GL3 in which two vehicles FZ1 and FZ2 or FZ4 and FZ5 are traveling on each. In track section GL1, the vehicles FZ1 and FZ2 are traveling coming from opposite directions. Vehicle FZ1 has consequently passed the left transponder TP11 and vehicle FZ2 has passed the right transponder TP12. In contrast to this, the vehicles FZ4 and FZ5 on track section GL3 are traveling coming from the same direction, wherein they have only passed the left transponder TP31. If the vehicles FZ1 and FZ2 or FZ4 and FZ5 have received the same coefficient set, which is used to process the data transmitted via the second transmission path, then in the vehicles FZ1 and FZ2 or FZ4 and FZ5, it can no longer be clearly determined which vehicle FZ1 or FZ2 or FZ4 or FZ5 is the provided receiver of data transmitted from the base station BST.

If the vehicles FZ are always traveling from opposite directions in a track section GL (see, for example, the situation in track section GL1), the two transponders TP11, TP12; TP21, TP22; or TP31, TP32, which define a track section GL1; GL2 or GL3, are preferably associated with different coefficient sets, by means of which the extraction of the data transmitted via the second transmission path can take place correctly in a vehicle. The number of the necessary codes, frequency channels, or time slots therefore doubles with this measure.

If the vehicles FZ are always traveling in the same direction on a track section GL3, (e.g. see the situation in the track section GL1), they receive from the passed transponder (TP31) the same coefficient set by means of which in the vehicles FZ4 and FZ5, physical separation of the signals designated for these two vehicles FZ4 and FZ5 is no longer possible. It is therefore provided that each vehicle FZ4, FZ5, upon entering the track section GL3, has a preferably one-time transmission authorization for sending one or a number of messages. The send message, which has been sent by the vehicle FZ4; FZ5 to the base station BST, is triggered by the receipt of the coefficient set when the transponder TP31 is passed. In so doing, the base station BST is informed of the identification number individually established for the vehicle FZ4; FZ5.

A table is kept in the base station and in this table, for each train entry reported, a data set is opened in which the reported identification number as well as the number of the track section are stored, which numbers are directly or indirectly transmitted by the vehicle FZ4; FZ5. For example, the messages transmitted to the base station BST are encoded in accordance with the coefficient set, whereupon a determination is carried out in the base station BST as to which coefficient set that is clearly associated with a track section GL or transponder TP can be used to correctly decode the message. To that end, all of the allocated coefficient sets are stored in the base station BST, with the associated track sections GL and transponders TP. In lieu of this, the number of the track section, together with the identification number of the vehicle FZ4; FZ5 is incorporated directly into the preferably security-encoded message. Preferably, the registering time of the vehicle FZ4; FZ5 is also registered in the table, by means of which if necessary, after making contact with the relevant vehicle, a test can be carried out as to whether the stored data are still current.

Other messages (with, for example, current position report, actual speed, etc.) are only transmitted by the vehicle FZ4; FZ5 when there is a request from the base station BST, which if need be, occurs cyclically at regular intervals or according to a priority list. The messages that are transmitted to the vehicles FZ4; FZ5 by the base station BST contain the identification number of the vehicle FZ4; FZ5 as an address. The vehicles FZ4; FZ5 which receive the signals that are encoded or modulated in accordance with the coefficient set of their track section GL3, can therefore determine by means of the identification number contained in the message whether the message received should be processed further.

If the signals are transmitted in accordance with the code- or frequency division multiplexing process, then all track sections GL can be queried at the same time. The individual vehicles FZ4; FZ5, however, which have entered the same track section GL3 in the same direction, can only be queried sequentially, as has been described. The evaluation of query messages is carried out on the vehicle end by means of a logic circuit. The identification number contained in the message header is compared in the vehicle FZ4; FZ5 with its own. If they coincide, the message is evaluated, otherwise it is rejected.

Figure 11:
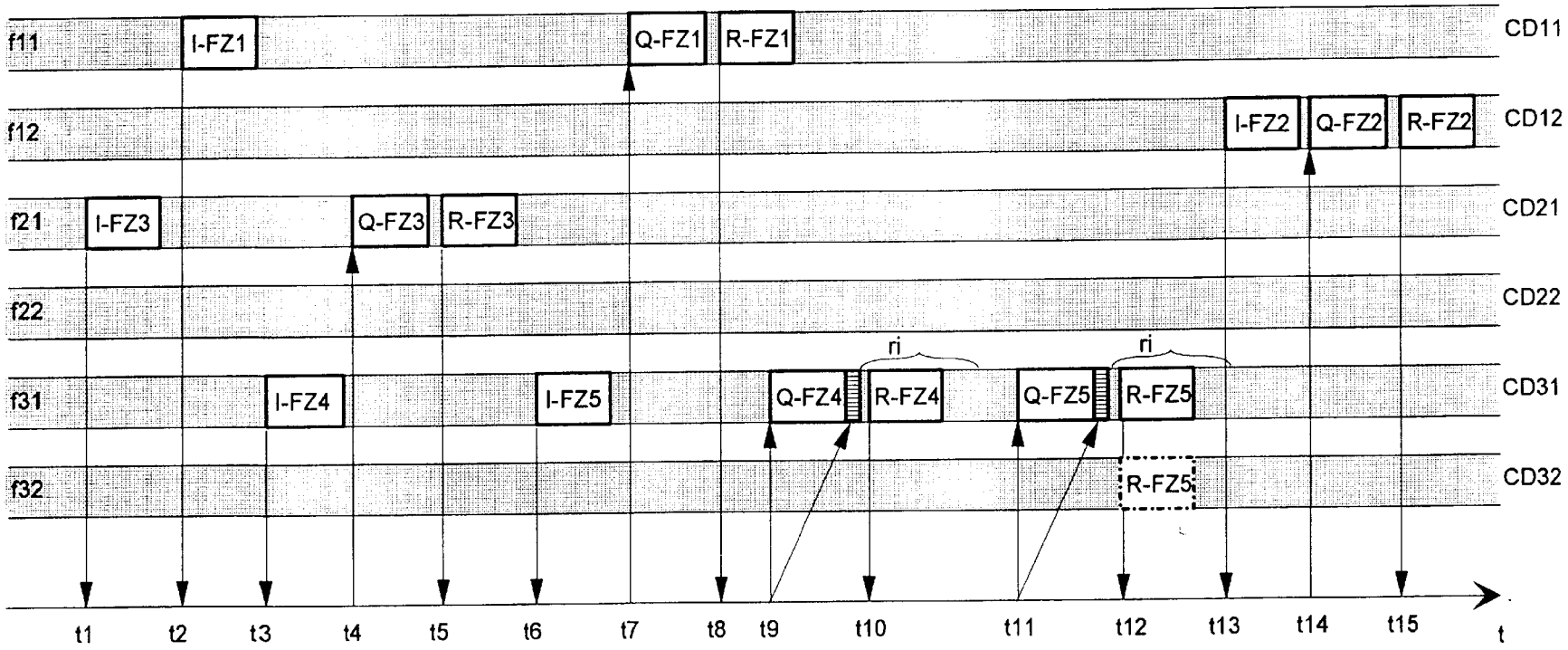
FIG. 11 shows the message traffic between the vehicles shown in FIG. 10 and the base station.

The communication process between the vehicles FZ1, . . . , FZ5 shown in FIG. 10 and the base station BST is explained in more detail in conjunction with the diagram shown in FIG. 11. In this case, it is assumed that coefficient sets are stored in the transponders TP11; . . . ; TP32, and each of these sets refers to a frequency channel f11, . . . , f32 (or a code word CD11; . . . ; CD32).

Upon entry into the track section GL2 or upon passing the transponder TP21, the vehicle FZ3 receives a coefficient set from the transponder TP21. Immediately after this, at time t1, a registration message I-FZ3 is sent via the frequency channel f21 to the base station BST, which at least contains the identification number of the vehicle FZ3. The coefficient set, which is associated with the track section GL2 and the transponder TP21 or the entry direction, is directly or indirectly transmitted, as explained above. Then, the sending and receiving stage of the vehicle FZ3 returns to receiving. Based on the registration I-FZ3 transmitted via the frequency channel f21, a determination is made in the base station BST that the vehicle FZ3 has entered into the track section GL2 by way of the transponder TP21. The corresponding data are stored in a new data set of the table.

At times t2 and t3, the vehicles FZ1 and FZ4 travel over the transponders TP11 or TP31 into the track sections GL1 or GL3 and register themselves with the base station BST via the radio channels f11 or f31 with messages I-FZ1 or I-FZ4, whereupon the table kept in the base station BST is correspondingly supplemented.

At times t4 and t7, queries Q-FZ3 or Q-FZ1 are transmitted by the base station BST via the frequency channels f21 or f11 registered in the table to vehicles FZ3 and FZ1, in which the received signals are supplied to a filter that is modulated to the predetermined frequency channel f21 or f11. By means of the queries Q-FZ3 or Q-FZ1, the vehicles FZ3 and FZ1 obtain authorization to transmit response messages R-FZ3 or R-FZ1, which are transmitted to the base station BST at times t5 and t8, respectively, and are decoded there.

At a time t13, the vehicle FZ2 travels over the transponder TP12 into the track section GL1 on which the vehicle FZ1 is already disposed. Upon passing the transponder TP12, a coefficient set is transmitted to the vehicle FZ2, by means of which its sending and receiving unit is set to the frequency channel f12, via which the communication between the base station BST and the vehicle FZ2 subsequently occurs (see: registration I-FZ2 at time t13, query Q-FZ2 at time t14, and response message R-FZ2 at time t15). The data transmission between the vehicles FZ1 and FZ2, which are disposed on the same track section, and the base station BST is therefore carried out on separate frequency channels f11 and f12.

At a time t6, the vehicle FZ5 travels over the transponder TP31 into the track section GL2 on which the vehicle FZ4 is already disposed. When passing the transponder TP31, a coefficient set is transmitted to the vehicle FZ5, by means of which its sending and receiving unit is set to the frequency channel f31 via which the vehicle FZ4 has already registered itself with the base station BST at time t3. After the registration I-FZ of the vehicle FZ5 has been carried out, both vehicles FZ4 and FZ5 that are set to the same frequency channel f31 should be able to be queried by means of the base station BST, which for this purpose adds to the query messages (Q-FZ4 at time t9 and Q-FZ5 at time t11) the transmitted identification number of the vehicles FZ4 and FZ5 to be contacted. By means of the identification numbers, the vehicles FZ4 and FZ5 can identify the messages designated for them. After each query Q-FZ, an interval ri is provided during which the queried vehicle FZ4 or FZ5 has the sole sending authorization for the relevant frequency channel f31 and can transmit a response message (R-FZ4 at time t10 and R-FZ5 at time t12) to the base station BST.

Although the vehicles FZ1, FZ2, and FZ3 occupy the allocated frequency channels f11, f12, and f21 alone, preferably an address for the query messages sent to them is provided by means of the identification number transmitted.

Furthermore, the base station BST can require a vehicle FZ to execute a channel change. With the query message Q-FZ5, the base station BST can require the vehicle FZ5 to change to the free channel f32. Furthermore, the base station BST can allocate time slots to the vehicles FZ4 and FZ5, within which the vehicles FZ4 and FZ5, with or without a previous requirement, can cancel messages to the base station BST. In the allocation of time slots, preferably each cycle is initialized by means of a time signal from the base station BST. Within the cycle, preferably a time slot is kept open for new registrations, which is not permitted to be occupied by the already registered vehicles FZ and the base station BST.

Upon receipt of a registration message I-FZ from a vehicle FZ, it is not known to the base station BST which transponder TP the vehicle FZ has passed and which coefficient set is consequently being used in this vehicle FZ. The base station BST must therefore test the registration messages I-FZ in accordance with all of the allocated coefficient sets and determine which coefficient set was used. To that end, preferably a test word or the coefficient set used in the vehicle FZ is added the registration message I-FZ, which are correctly received in the base station BST through the use of the applicable coefficient set. The receiving and decoding circuit used in the base station BST preferably corresponds to the receiving and decoding circuit provided in the vehicle FZ, with the difference that the receiving and decoding circuit provided in the base station BST is supplied with the allocated coefficient sets sequentially until the test word transmitted in the registration message or the coefficient set is recognized as correct. To that end, the registration message I-FZ is, for example, digitized and stored in a memory, from which it can be read and linked with the sequentially supplied coefficient sets. For this purpose, a processor is provided internally or externally, which is connected to the base station BST. Alternatively to this, the registration message I-FZ can be processed and tested in parallel in a number of receiving circuits. With the use of the frequency division multiplexing process in which, for example, four frequency channels are provided, the registration message I-FZ is supplied, for example simultaneously, to the band-pass filters BP1, . . . , BP4 shown in FIG. 5. By means of the band-pass filter BP, at whose output the registration message I-FZ is transmitted with the correct test word or coefficient set, the position of the vehicle FZ can be determined.

As described above, an allocation of the frequency channels f11, . . . to the vehicles FZ11, . . . takes place by means of the coefficient sets transmitted by the transponders TP. Likewise, the vehicles FZ11, . . . can be associated with the numbers of time slots or, as shown in FIG. 11, code words CD11, . . . , CD32 so that the data transmission between the vehicles FZ11, . . . and the base station BST can take place in accordance with a code-, time-, or frequency division multiplexing process (CDMA, FDMA, TDMA process as described in E. Herter/W. Lörcher, Nachrichtentechnik [Communications Engineering], Hanser Verlag, Munich 1994, Chapter 8.8.3.2). With a high demand for transmission channels, the modulation and multiplexing process can furthermore be used in combination (e.g. a coefficient set determines, for example, that the relevant vehicle may transmit encoded and phase-modulated signals on the frequency channel f12 in a time slot x).

The transponders TP can, for example, be definitely programmed, as is described in U.S. Pat. No. 5,115,160. Preferably, though, transponders TP are used which are suited for the transmission of coefficient sets that can be alternatively fixed. For this purpose, the base station BST is preferably connected by way of the line antenna or other transmission lines to an alternatively programmable, ground-based transponder TP, as has been disclosed by EP 0 620 923 A1. As a result, the allocation of the frequency channels, the code words, or the time slots can be changed if need be.

Figure 12:
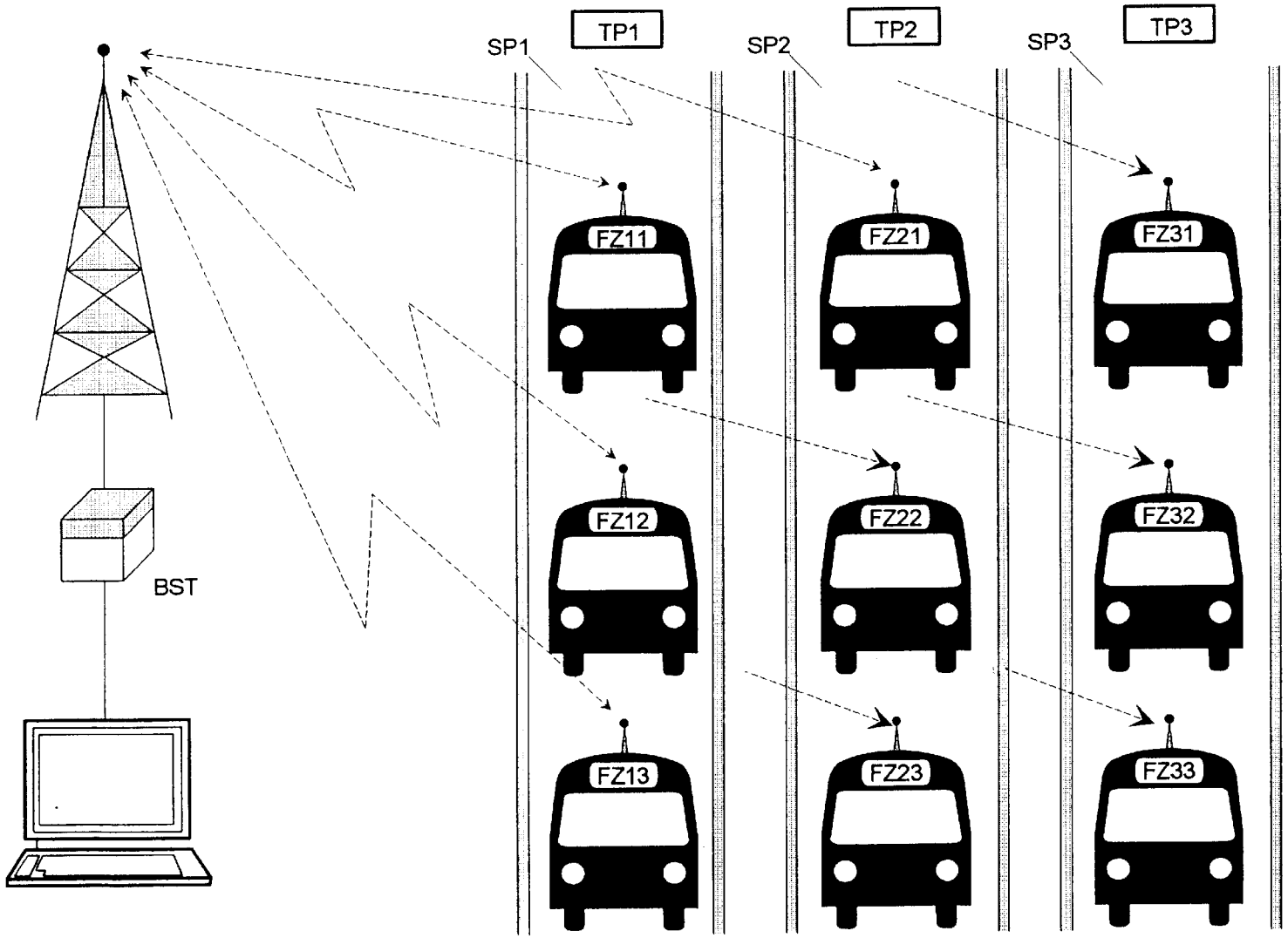
FIG. 12 shows a fleet with busses that communicate with a base station.

In particular, the invention can also be advantageously used for the control and monitoring of bus traffic. Particularly in a bus yard, as shown in FIG. 12, with dozens of busses FZ1, . . . , FZ33, a number of which (FZ11, FZ12, FZ12, or FZ21, FS22, FZ23, or FZ31, FZ32, FZ33) are driven in and are parked in neighboring lanes SP1, SP2, SP3 that are each provided with transponders TP1, TP2, TP3, the process according to the invention permits the simple management and control of the vehicles FZ11, . . . , FZ33, which can be selectively queried by the base station BST. After the entry of the busses FZ11, . . . , FZ33, their status, for example, can be queried, after which the disposition for the remaining trips can be carried out.

The data transmission via the second transmission path is preferably carried out in both transmission directions with the same modulation, code, and/or frequency division multiplexing process. However, it is also possible to provide separate coefficient sets for the two transmission directions, which are used analogously.

What is claimed is:

1. A process for engineering a traffic communication system, the system having at least one ground-based transponder, comprising:

monitoring at least one section of a line;

transmitting first data on a first transmission path to at least one vehicle having a sending and receiving unit, when the at least one section of a line is traveled over by the at least one vehicle;

transmitting individually modulated multiplexed signals from a base station on a second transmission path to the at least one vehicle, the signals being formed by at least one of the code division multiplexing, time division multiplexing and frequency division multiplexing processes;

forming coefficients in accordance with the type of said multiplexing process provided for the second transmission path;

storing the coefficients in the transponder in one of fixed and variable format;

transmitting the coefficients via the first transmission path;

extracting the coefficients in a designated vehicle of the at least one vehicle;

using the coefficients for one of demodulation and demultiplexing signals transmitted on the second transmission path; and determining whether the signals transmitted on the second transmission path are designated for the designated vehicle and should be processed further.

2. The process according to claim 1, further comprising supplying the signals transmitted by the base station on the second transmission path, to the at least one vehicle, via one of: a line antenna provided in the at least one section of the line traveled over by the at least one vehicle, and a radio antenna that is common to a plurality of the at least one section of the line.

3. The process according to claim 1, wherein the signals transmitted via the second transmission path are at least one of:

modulated with regard to least one of frequency, phase, amplitude; and multiplexed with regard to one of time, code, and frequency.

4. The process according to claim 1, wherein the second transmission path provides for bidirectional transmission, further comprising using in both directions of transmission of the second transmission path, at least one of:

one of the same coefficients and different coefficients; and one of:

the same and different modulation process; and the same and different multiplexing processes.

5. The process according to claim 1, further comprising:

sending a registration message to the base station from each of at least one vehicle, after receipt of the coefficients transmitted via the first transmission path, the registration message comprising an identification number of a respective at least one vehicle; and using, by the base station, the identification number to address the respective at least one vehicle.

6. The process according to claim 5 further comprising decoding and demodulating the registration message received by the base station, the registration message containing one of a test word and a set of k coefficients, the k coefficients used in one of series and parallel until one of the registration message, the test word transmitted, and the k coefficients are recognized as being correct.

7. The process according to claim 5, wherein after sending the registration message, the at least one vehicle waits until it is prompted to send a response message to the base station, in response to a query message that is provided with the identification number.

8. The process according to claim 1, wherein the at least one section of a line comprises two line sections, each line section having two transponders, the two transponders having one of the same or different coefficients that are to be transmitted on the first transmission path to a respective at least one vehicle.

9. The process according to claim 1, further adapted for engineering one of rail and bus traffic.

10. A traffic engineering communication system comprising:

at least one vehicle having a sending and receiving unit;

at least one monitored line section having at least one ground-based transponder, said at least one ground-based transponder adapted to transmit first data on a first transmission path to said at least one vehicle; and a base station adapted to transmit individually modulated multiplexed signals from a base station on a second transmission path to said at least one vehicle, said signals being at least one of code division, time division and frequency division, the signals comprising signal data;

wherein said transponder is adapted to store a plurality of coefficients formed in accordance with said signals in one of fixed and variable format and transmitted on the first transmission path, said at least one vehicle being adapted to extract said coefficients, said at least one vehicle being further adapted to perform one of demodulation and demultiplexing of said signals transmitted on the second transmission path, and said one vehicle being further adapted to test said signals transmitted on the second transmission path.

11. The traffic engineering communication system according to claim 10, wherein said base station is connected to at least one of an antenna and at least one line antenna disposed along said at least one monitored line section, wherein said base station and said at least one vehicle are each adapted to transmit said signals therebetween in a bidirectional manner.

12. The traffic engineering communication system according to claim 11, wherein said base station is connected to said at least one line antenna, said at least one line antenna being a leakage cable.

13. The traffic engineering communication system according to claim 11, wherein said base station comprises a table adapted to store signal data sent by said at least one vehicle.

14. The traffic engineering communication system according to claim 10, wherein said at least one transponder is connected to said base station by way of one of a transmission lines and a line antennae.

15. The traffic engineering communication system according to claim 10, wherein said at least one vehicle further comprises:

a coefficient extractor adapted to extract k coefficients and supply the k coefficient to a separation stage;

one of a first receiving module and a joint receiving module adapted to supply the signals transmitted via the first transmission path to said coefficient extractor; and a separation stage adapted to receive k coefficients, and further adapted to receive signals from one of a second receiving module and said joint receiving module, said separation stage further adapted to perform one of demodulation and demultiplexing of said signals transmitted on the second transmission path, said separation stage further adapted to test said signals in conjunction with said k coefficients.

16. The traffic engineering communication system according to claim 15, wherein said separation stage comprises one of:

at least one bandpass filter adapted to be adjusted in conjunction with the transmitted coefficients k in such a way that a signal with a particular frequency can be filtered out of a signal mixture transmitted in accordance with a frequency division multiplexing process;

a receiving-end signal extraction system adapted for adjustment in conjunction with the transmitted coefficients k in such a way that a signal transmitted at a particular time can be extracted from a signal mixture transmitted in accordance with a time division multiplexing process; and a CDMA correlator adapted for one of correlation or demodulation, adapted for adjustment in conjunction with the transmitted coefficients k in such a way that a signal encoded in accordance with the CDMA process may be decoded, and interference signals may be simultaneously suppressed.

17. The traffic engineering communication system according to claim 16, said CDMA correlator comprising:

a multiplier adapted to receive a CDMA-encoded signal and a code, and further adapted to deliver a product to a demodulator/integrator;

a demodulator/integrator adapted to receive a product from said multiplier; and a code generator adapted to supply a code to said multiplier as a function of the coefficients k;

wherein said demodulator/integrator is adapted to shift the signal into a base band, and is further adapted to spread, integrate and test the signal.

18. The traffic engineering communication system according to claim 17, further comprising an evaluation unit adapted to test and evaluate transmitted signal data, and further adapted to receive the signal from said demodulator/integrator;

wherein said demodulator/integrator is adapted to supply the signal to said evaluation unit.

19. The traffic engineering communication system according to claim 10, wherein said base station further comprises a separation stage adapted to perform one of demodulation and demultiplexing of said signals transmitted via the second transmission path, and further adapted to perform one of testing of said signals in conjunction with said k coefficients, said separation stage further adapted to determine which of said at least one monitored line section and in what direction said at least one vehicle, whose signal has been one of demodulated and demultiplexed, is moving.

* * * * *